United States Patent [19]

Matsui et al.

[11] 4,363,018

[45] Dec. 7, 1982

[54] ELECTRONIC COMPONENTS OF ROTARY TYPE

[75] Inventors: Hiroshi Matsui; Masayoshi Kakumu, both of Hirakata, Japan

[73] Assignee: Matsushita Electric Industrial Co., Ltd., Kadoma, Japan

[21] Appl. No.: 203,550

[22] Filed: Nov. 3, 1980

[51] Int. Cl.[3] ..... H01C 10/36

[52] U.S. Cl. ..... 338/172; 338/184; 338/191; 338/197; 338/198; 338/199; 338/200

[58] Field of Search ..... 338/172, 179, 198, 164, 338/184, 191, 199, 198, 197, 200, 315

[56] References Cited

U.S. PATENT DOCUMENTS

| | | | |
|---|---|---|---|
| 2,231,540 | 2/1941 | Lodge | 338/164 X |
| 2,836,686 | 5/1958 | Barden et al. | 338/172 X |
| 2,958,838 | 11/1960 | Puerner et al. | 338/172 X |
| 3,924,220 | 12/1975 | Matsui et al. | 338/198 X |

*Primary Examiner*—C. L. Albritton

*Attorney, Agent, or Firm*—Cushman, Darby & Cushman

[57] ABSTRACT

In an electronic component of rotary type comprising a bearing sheath which has a front portion and a rear portion and is to be fixedly mounted on a frame of an electric appliance, an operation shaft disposed in the bearing sheath, a substrate fixed at a rear part of the bearing sheath, a brush holder mounted on an end portion of the operation shaft in a manner to be rotated by rotation of the operation shaft, and at least one sliding contact brush mounted on the brush holder for sliding on a contacting member formed on a surface of the substrate, the improvement is that a central portion of the operation shaft is disposed in the bearing sheath and has an outer diameter smaller than an inner diameter of the bearing sheath, and that the electronic component is free from irregular rotation during the rotation of the operation shaft.

22 Claims, 5 Drawing Figures

ELECTRONIC COMPONENTS OF ROTARY TYPE

BACKGROUND OF THE INVENTION

1. Field of the Invention:

This invention relates to an electronic component of rotary type.

2. Description of the Prior Art:

The following description will be given for a rotary variable resistor which forms one example of a conventional electronic component of rotary type. The conventional rotary variable resistor (potentiometer) is comprised of an operation shaft journaled in a bearing sheath provided with a threaded portion at the front end. A constant diameter central portion of an operation shaft is journaled in the bearing sheath so that the front tip of the operation shaft does not shake when the shaft is rotated. A brush holder (rotational body) is fixed at the rear tip of the operation shaft.

In actual use, the rotary variable resistor is mounted at a hole in a chassis and is fixed in place by a nut at the threaded part of the bearing sheath. The front tip of the operation shaft projects out of the hole beyond the front panel containing the hole. The diameter in the hole of the (front) panel is larger than that of the operation shaft. Therefore, even where the operation shaft axis does not lie at a correct place, i.e. at the center on the hole of the (front) panel at the mounting of the rotary variable resistor, the operation shaft does not abut the rim of the hole. Any space between the outside face of the shaft and the rim of the hole is covered by a knob, the external diameter thereof having been hitherto much larger than that of the operation shaft.

Recently, small-sized audio appliance sets such as car stereos have become popular. In such small-sized audio appliance sets with a number of rotary variable resistors disposed and lined up in front of a small-sized front panel, it is necessary to reduce the external diameter of knobs used for the rotary variable resistors and to reduce the sizes of the rotary variable resistor per se. In this situation, it becomes difficult to cover spaces around the hole of the front panel by use of the external portion of the knobs. In order to overcome this difficulty, it may be necessary to reduce the size of the spaces at the hole in the (front) panel around the shaft down to nearly zero. But, this causes problems in that the operation shaft becomes liable to abut on the internal rim of the hole at the (front) panel thereby increasing rotational torque due to friction between the shaft and the rim of the hole during rotational operation thereby generating irregular rotation of the operation shaft. In particular, when an operation shaft is moved back and forth in order to switch on and off a push switch means mounted on a rotary variable resistor, the abovementioned abutment of the operation shaft brings about fatal operational difficulties.

SUMMARY OF THE INVENTION

The present invention provides a rotary type electronic component free from irregular rotation problems.

BRIEF DESCRIPTION OF THE DRAWING

FIG. 3(*b*) is a cross-sectional view taken on line A—A in FIG. 3(*a*).

DESCRIPTION OF THE PREFERRED EMBODIMENTS

The preferred embodiments will be described for several example structures embodying the present invention where the electronic components are rotary variable resistors.

Figure 1:
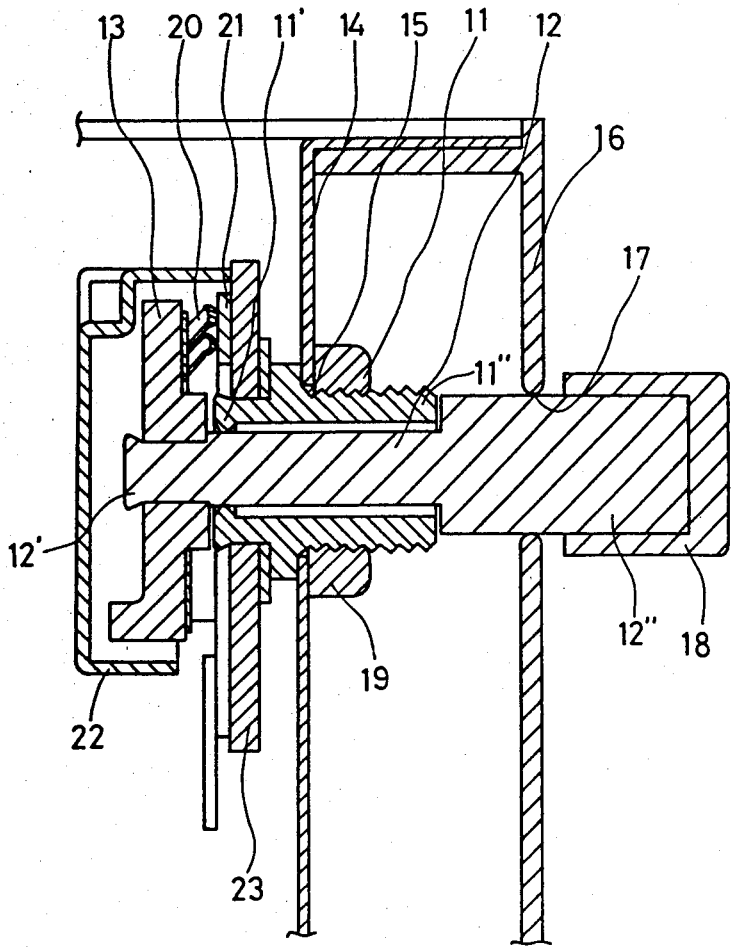
FIG. 1 is a cross-sectional view of a first example of a rotary variable resistor with the improvement in accordance with the present invention.

FIG. 1 is a cross-sectional view of a first example of a rotary variable resistor in accordance with a first embodiment of the present invention. An operation shaft 12 is rotatably journaled in a bearing sheath 11. A revolving brush holder 13, which is a revolving body, is fixed at one tip 12' of the operation shaft 12. The main portion of operation shaft 12 is enclosed in a through-hole of bearing sheath 11; shaft 12 has a constant diameter smaller than an inner diameter of the main part of the through-hole of bearing sheath 11. Operation shaft 12 is pivotally journaled by a ring-shaped inwards protruded portion 11' at the left tip of bearing sheath 11. Brush holder 13 is provided with a pair of brushes 20 which slidably move on the surface of a resistor layer 21 formed on a surface of a substrate 23 fixed to the bearing sheath 11. A rear cover 22 is fixed to bearing sheath 11, which is with sheath 11 being fixed with respect to a hole 15 on chassis 14 by inserting a screw-threaded portion of bearing sheath 11 into hole 15 and then attaching a nut 19. An operating end tip 12" of the operation shaft 12 with a knob 18 thereon has a diameter larger than that of the sheathed portion, and projects from a hole 17 in (front) panel 16. Even in a situation where the space between operating end tip 12" and hole 17 is limited and hole 17 is not concentric with hole 15, smooth rotational operation is obtainable by the structure shown in FIG. 1. This is because operation shaft 12 is pivotally supported by the ring-shaped protruded portion 11' of bearing sheath 11 and because the operation shaft 12 can be tilted easily without abutting on a brim 11" of the bearing sheath 11.

Figure 2:
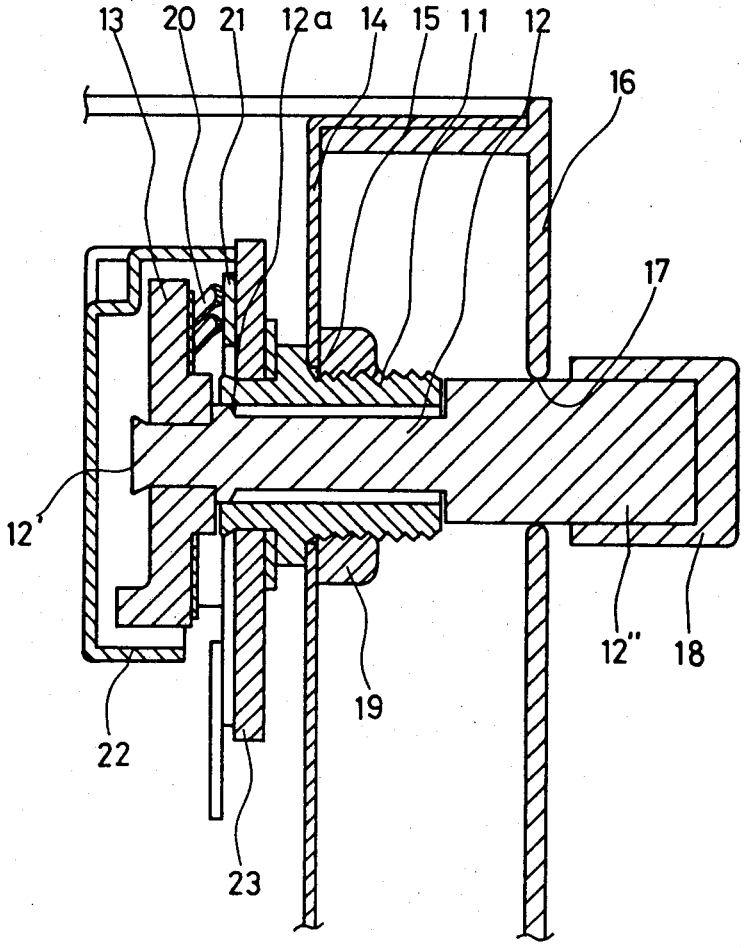
FIG. 2 is a cross-sectional view of a second example of a rotary variable resistor with another improvement in accordance with the present invention.

FIG. 2 is a cross-sectional view showing a second example of a rotary variable resistor in accordance with a second embodiment of the present invention. This is a modified example where an operation shaft 12 is provided with a ring-shaped protruded portion 12*a* which rotatably fits on the inner face of bearing sheath 11. By provision of the ring-shaped protruded portion 12*a* on the side of the operation shaft 12, similar operational advantages are obtainable in that the operation shaft 12 can be tilted without losing its smooth rotational operation.

Since brush holder 13 is fixed to the operation shaft 12 in the first and the second examples, brush holder 13 is tilted a little where the operation shaft 12 is tilted in its use. When brush holder 13 is tilted, brushes 20 trace on the surface of the resistor layer 21 with varying contact pressure, a little differently from the designed state. This trace difference can be reduced considerably by providing the ring-shaped protruded portion 11' (or 12*a*) at a position nearest the center of the brush holder 13. Furthermore, the trace difference of the brushes 20 can be perfectly removed by employing a structure to be described below.

Figure 3A:
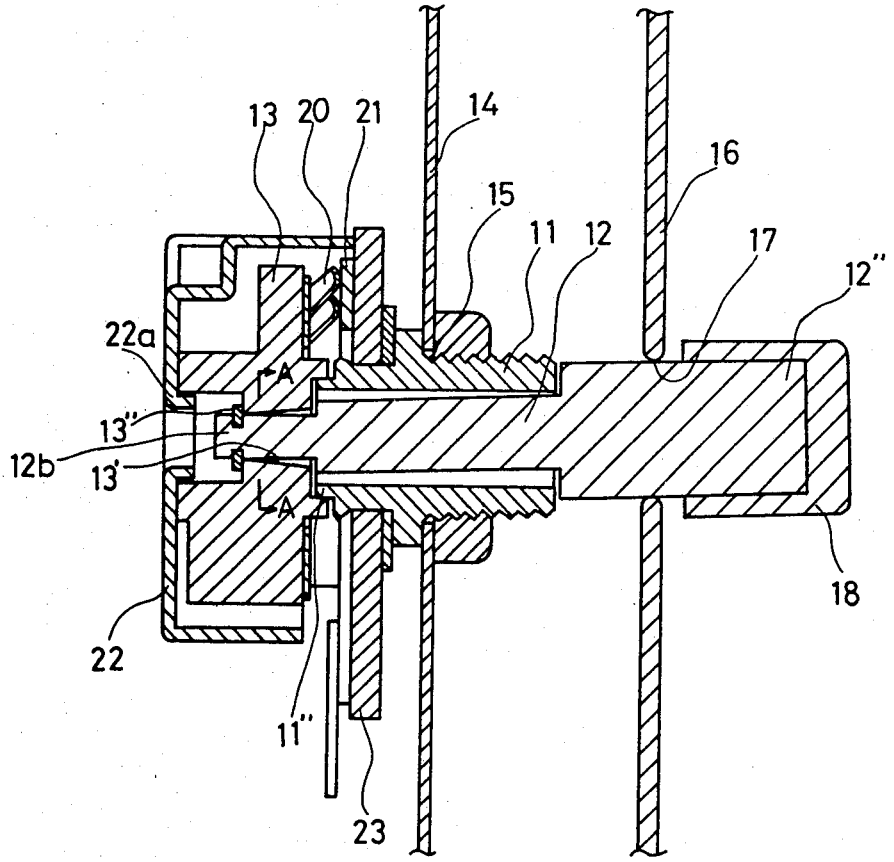
FIG. 3(*a*) is a cross-sectional view of a rotary variable resistor with still another improvement in accordance with the present invention.
Figure 3B:
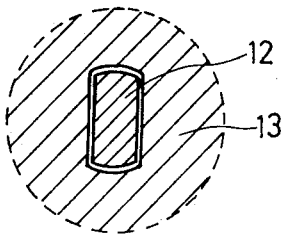

FIG. 3(*a*) is a cross-sectional view showing still another example of a rotary variable resistor in accordance with the present invention. FIG. 3(*b*) is a cross-sectional view taken on line A—A in FIG. 3(*a*). A bearing sheath 11 has an inner diameter larger than that of a central portion of an operation shaft 12, similar to the aforementioned embodiments. In addition, a brush holder 13 is rotatably supported by ring-shaped protruded portions at a foot 11″ of the bearing sheath 11 and at a rear portion 22*a* of a rear cover 22. Therefore, brush holder 13 does not tilt with respect to the resistor layer 21 when the operation shaft 12 is rotated. Furthermore, the operation shaft 12 is pivotally fixed at a tip portion 12*b* thereof by use of a fixing washer 13″. The tip portion 12*b* has a cross section of an elongated, namely non-circular, shape as shown in FIG. 3(*b*). The brush holder 13 also has a through-hole 13′ with an elongated cross-sectional shape and a tapered shape in an axial direction along the operation shaft 12, as shown in FIGS. 3(*b*) and 3(*a*). Thus, the other tip portion 12″ can tilt within a predetermined angle when the bearing sheath 11 is mounted on a case chassis 14 and the other tip portion 12″ is inserted into a hole 17 of a case panel 16.

By employing the structure shown in FIG. 3(*a*), the operation shaft 12 can be smoothly rotated even where it is tilted in the bearing sheath 11 (as shown). The brush holder 13 does not tilt at all during the rotational movement of the operation shaft 12, and therefore there arises no non-uniformity of the trace movement by a pair of brushes 20 on the surface of a resistor layer 21.

Figure 4:
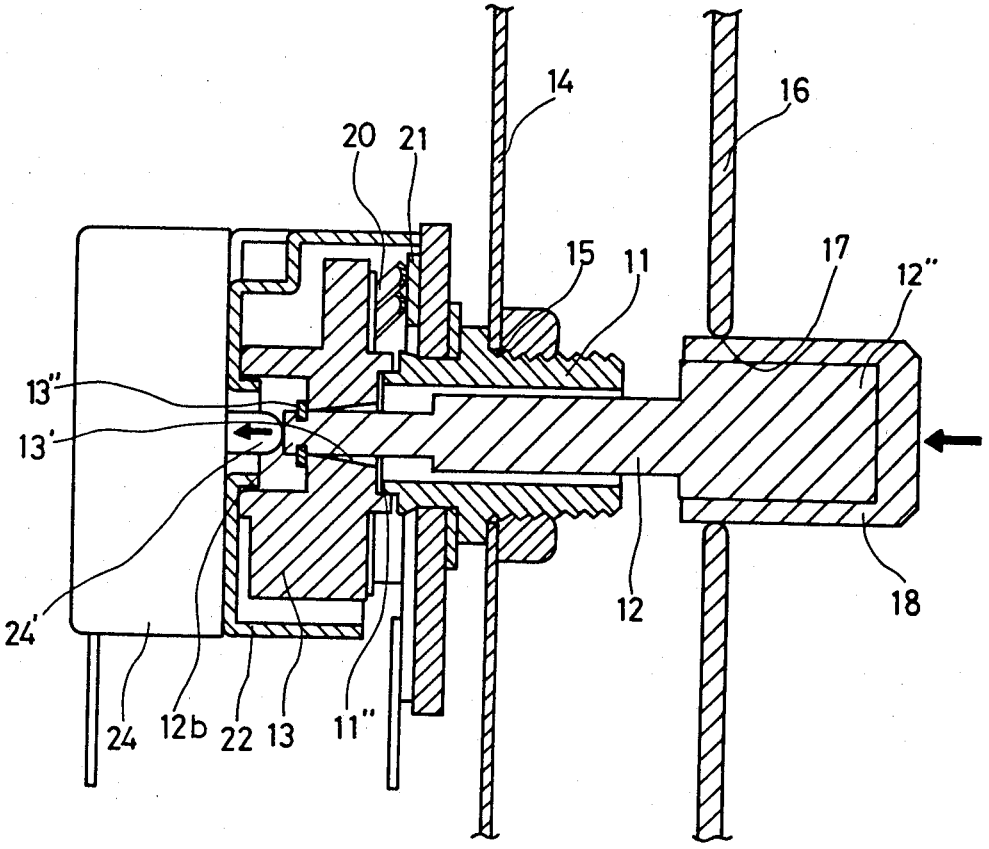
FIG. 4 is a cross-sectional view of still another example of a rotary variable resistor, with a push switch means.

FIG. 4 is a cross-sectional view of still another example of a rotary variable resistor, with a push switch means. In addition to rotational operation similar to the case of FIG. 3(*a*), an operation shaft 12 is movable back and forth so as to turn on and off a switch means 24. A tip portion 12*b* with a fixing washer 13″ moves independent from a brush holder 13 and pushes a knob 24′ of the switch means 24. In this embodiment, a knob 18 disposed at a tip 12″ of the operation shaft 12 is rotatably and slidably supported by a hole 17 of a front panel 16.

The above descriptions have been made for rotary variable resistors as the examples. But, it is possible to embody the present invention for other electronic components such as rotary switches. In other words, the present invention is applicable to various electronic components provided with rotational operation shafts.

What is claimed is

1. An electronic component for electrical equipment comprising:

a bearing sheath having a front and rear end and an axially extending bore therein, said sheath being fixed on a frame of the electrical equipment, an operational shaft having portions extending internally and externally of said electrical equipment, said operational shaft being pivotally disposed in said bearing sheath, a substrate fixed to the rear end of said bearing sheath having means defining a resistor layer thereon, a brush holder mounted on the internal portion of said operational shaft so as to be rotated by rotation of said operational shaft, and at least one contact mounted on said brush holder for operatively contacting said resistor layer means formed on said substrate, wherein a central portion of said operational shaft is disposed in said bearing sheath and has an outer diameter smaller than the diameter of the bore in said bearing sheath, and said operational shaft is pivotally held near said internal portion so that the external portion of said operational shaft has degrees of freedom in all tilting directions.

2. An electronic component as in claim 1, wherein said bearing sheath is provided with a protruded portion on the inner wall of said bearing sheath thereby pivotally supporting said operational shaft.

3. An electronic component as in claim 2, wherein said brush holder has means defining a tapered through-hole extending in an axial direction of said operational shaft, and said internal portion of said operational shaft being fixedly secured to said brush holder interiorly of said tapered through-hole means.

4. An electronic component as in claim 3, wherein said brush holder is provided with a protruded ring portion for engaging the rear end of said bearing sheath.

5. An electronic component as in claim 4, further including a rear cover secured to said brush holder.

6. An electronic component as in any one of claims 1, 2, 3, or 4, further including push switch means to be switched by pushing movement of said operation shaft.

7. An electronic component as in claim 5, further including a push switch means to be switched by pushing movement of said operation shaft.

8. An electronic component for electrical equipment comprising:

a bearing sheath having a front and rear end, and an axially extending bore therein, said sheath being fixed on a frame of the electrical equipment, an operational shaft having portions extending internally and externally of said electrical equipment, said operational shaft being pivotally disposed in said bearing sheath, a substrate fixed to the rear end of said bearing sheath having means defining a resistor layer thereon, a brush holder mounted on the internal portion of said operational shaft so as to be rotated by rotation of said operational shaft, and at least one contact mounted on said brush holder for operatively contacting said resistor layer means formed on said substrate, wherein a central portion of said operational shaft is disposed in said bearing sheath and has an outer diameter smaller than the diameter of the bore in said bearing sheath, and said operational shaft is privotally held near said internal portion so that the external portion of said operational shaft has degrees of freedom in all tilting directions, wherein said brush holder has means defining a through-hole extending with an elongated cross-sectional shape and a tapered shape in an axial direction of said operational shaft, and said internal portion of said operational shaft is fixed to said brush holder by a fixing washer positioned interiorly of said tapered through-hole means.

9. An electronic component as in claim 8, wherein said brush holder is provided with a protruded ring portion for engaging the rear end of said bearing sheath.

10. An electronic component as in claim 9, further including a rear cover secured to said brush holder.

11. An electronic component as in claim 8, further including push switch means to be switched by pushing movement of said operation shaft.

12. An electronic component as in claim 9 or 10, further including a push switch means to be switched by pushing movement of said operation shaft.

13. An electrical control device for electrical equipment comprising mounting means for mounting the device to the frame of the electrical equipment, a control shaft having front and rear portions and being pivotally secured so as to define a pivot point adjacent its rear portion within said mounting means so that said control shaft can pivot therein, switch means mounted within said device and operatively connected to said control shaft for controlling the operation of at least a portion of said electrical equipment whereby said control shaft can pivot about the pivot point and extend between non-aligned mounting apertures provided within said electrical equipment.

14. An electric control component for use with electrical equipment comprising:

an electric switch control member having a hollow interior portion, and a control shaft pivotally mounted within the hollow interior portion of said electric switch control member so that a pivot point for said control shaft is defined therein, said control shaft being operatively connected thereto for operating said electric switch control member so that said control shaft can move radially with respect to the axis of the control shaft at the pivot point.

15. An electric control component as in claim 14, wherein said control shaft rotates within said hollow interior portion.

16. An electric control component as in claim 14, wherein said control shaft can slide axially within said hollow interior portion.

17. An electric control component as in claim 14, wherein said control shaft can rotate and slide axially within said hollow interior portion.

18. An electric control component as in claim 14, wherein said electrical equipment includes a plurality of adjacent structural panels and means defining openings therein, at least portions of said openings being aligned so that together they cooperate to define a passage through which said control shaft can extend, said control shaft having a front portion extending outwardly through said openings.

19. An electric control component as in claim 18, further including a knob secured to the front portion of said shaft, said knob being supported by said openings to allow said knob to rotate and slide axially within said openings.

20. An electric control component as in claim 14 or 15, wherein said electric switch control member comprises a rotatable variable resistor.

21. An electric control component as in claim 14 or 16, wherein said electric switch control member comprises a push-pull switch.

22. An electric control component as in claim 14 or 17, wherein said electric switch control member comprises a combination rotary and push-pull switch.

* * * * *